United States Patent [19]

Montana

[11] 4,342,374

[45] Aug. 3, 1982

[54] LADDER SUPPORT

[76] Inventor: Antonio Montana, 5 Gates Ave., Ossining, N.Y. 10562

[21] Appl. No.: 220,763

[22] Filed: Dec. 29, 1980

[51] Int. Cl.[3] ..... E06C 7/16; E04G 3/00

[52] U.S. Cl. ..... 182/45; 182/121; 182/200; 248/237; 248/238

[58] Field of Search ..... 182/45, 121, 122, 120, 182/178, 200; 248/237, 238, 235, 354 P

[56] References Cited

U.S. PATENT DOCUMENTS

| | | | |
|---|---|---|---|
| 168,355 | 10/1875 | Talbott | 182/45 |
| 666,526 | 1/1901 | Howard | 182/200 |
| 687,666 | 11/1901 | Spring | 248/237 |
| 711,384 | 10/1902 | Carman | 182/121 |
| 718,602 | 1/1903 | Chase | 182/45 |
| 1,339,482 | 5/1920 | Sederburg | 182/45 |
| 2,275,014 | 3/1942 | Hahler | 182/45 |
| 2,549,638 | 4/1951 | Rogghe | 248/237 |
| 2,848,282 | 8/1958 | Weber | 182/45 |

FOREIGN PATENT DOCUMENTS

| | | | |
|---|---|---|---|
| 1082717 | 9/1967 | United Kingdom | 182/178 |

*Primary Examiner*—Reinaldo P. Machado
*Attorney, Agent, or Firm*—Eugene E. Geoffrey, Jr.

[57] ABSTRACT

A ladder support for attachment to a first inclined ladder in order to support a second ladder extending upwardly therefrom which includes a base which is attached to the first ladder and bridges a plurality of rungs, a platform hinged at one end to the upper end of the base for supporting the second ladder and a strut assembly hinged to the lower end of the base and adjustably attached to the other end of the platform to hold the platform in a horizontal position.

4 Claims, 12 Drawing Figures

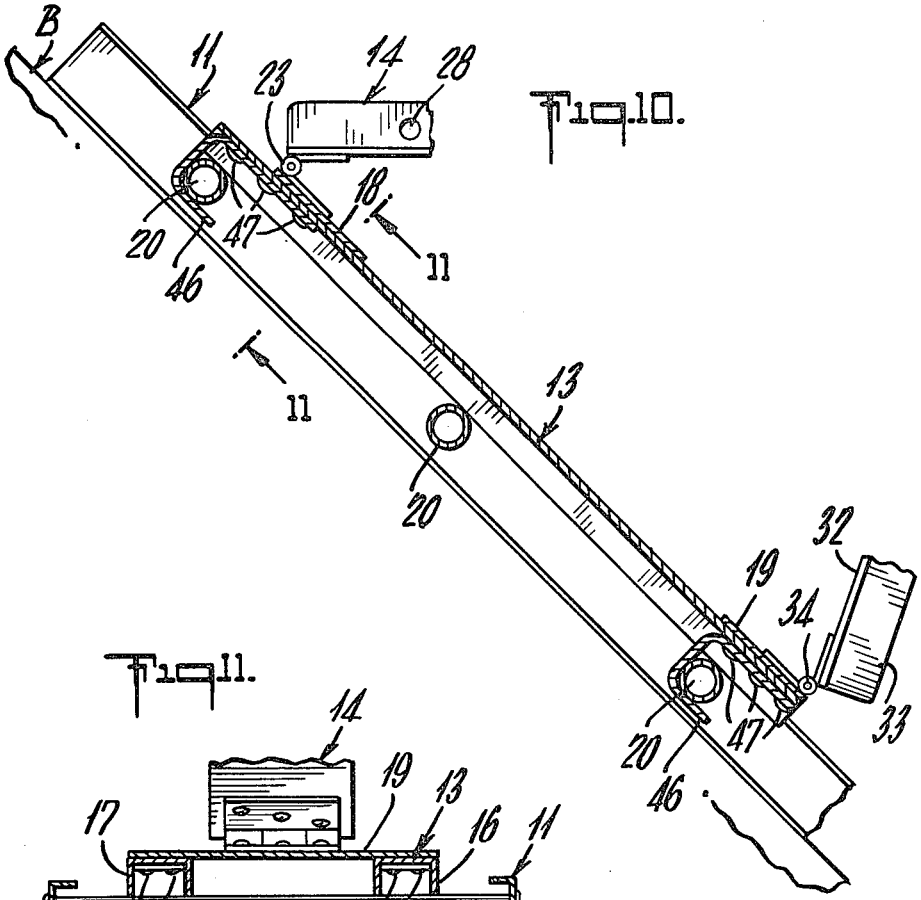
Fig.10.
Fig.11.
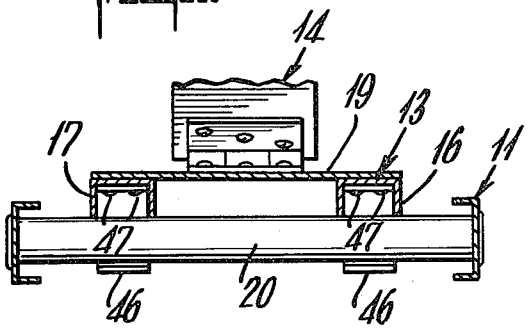
Fig.12.
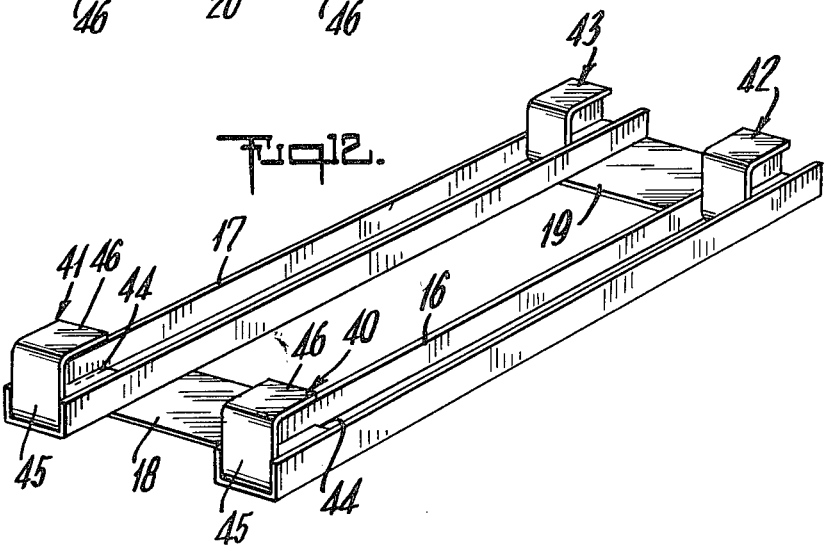

LADDER SUPPORT

This invention relates to supports for use in connection with ladders to enable workers such as painters, carpenters and the like to reach areas of buildings not readily accessible by a single ladder and more specifically to a novel and improved support that may be securely affixed to an inclined ladder and provide a horizontal platform to support a second ladder extending upwardly at about ninety degrees to the first ladder.

Ladder supports have heretofore been proposed for supporting one ladder on a second ladder but known devices have not been found satisfactory for a number of reasons including the difficulty of installation, inadequate security and undue stress on the rungs of the supporting ladder.

This invention overcomes the difficulties of prior known devices and provides a novel and improved support which may be quickly and easily placed in position on an inclined ladder to support a second ladder at a right angle to the first ladder and wherein the stress on the inclined ladder is distributed over a plurality of rungs of the inclined ladder.

Another object of the invention resides in the provision of a novel and improved ladder support formed of three interconnected portions and which when placed on an inclined ladder provides a rigid and secure support for a second ladder.

Still another object of the invention resides in the provision of a novel and improved ladder support which is relatively light in weight, compact and easily assembled and positioned on an inclined ladder. By reason of the novel arrangement and organization of elements, the position of the support on the inclined ladder can be quickly and easily shifted.

A still further object of the invention resides in the provision of a novel and improved ladder support.

The ladder support in accordance with the invention comprises a base portion adapted to lie against the rungs of an inclined ladder and having hooking means for engaging one or more ladder rungs to secure the base in position, a platform hinged to the upper end thereof and extending horizontally outwardly and a pair of struts hinged to the lower end of the base including means for adjustably engaging the outer end of the platform to maintain it in a horizontal position.

The above and other objects of the invention will become more apparent from the following description and accompanying drawings forming part of this application.

IN THE DRAWINGS

Figure 1:
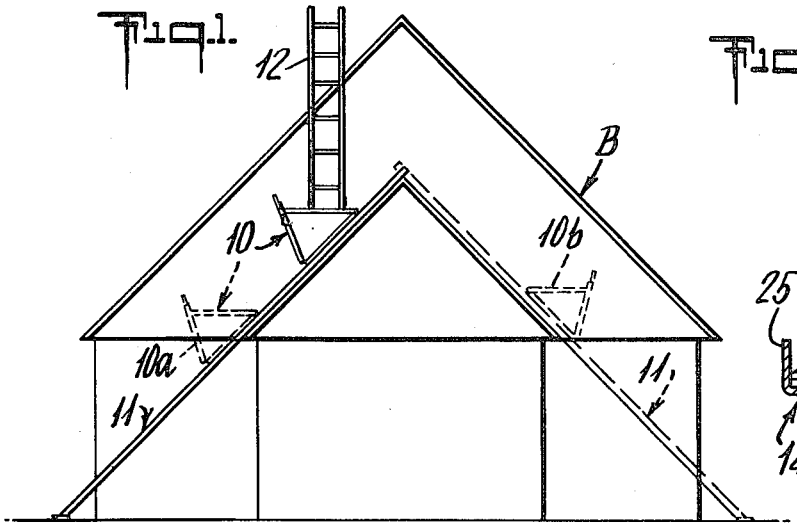
FIG. 1 is an elevational view of a building showing an inclined ladder carrying a support in accordance with the invention and a second ladder extending upwardly from the support.
Figure 9:
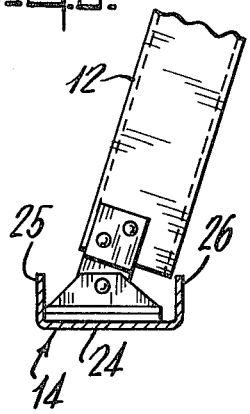
Figure 8:
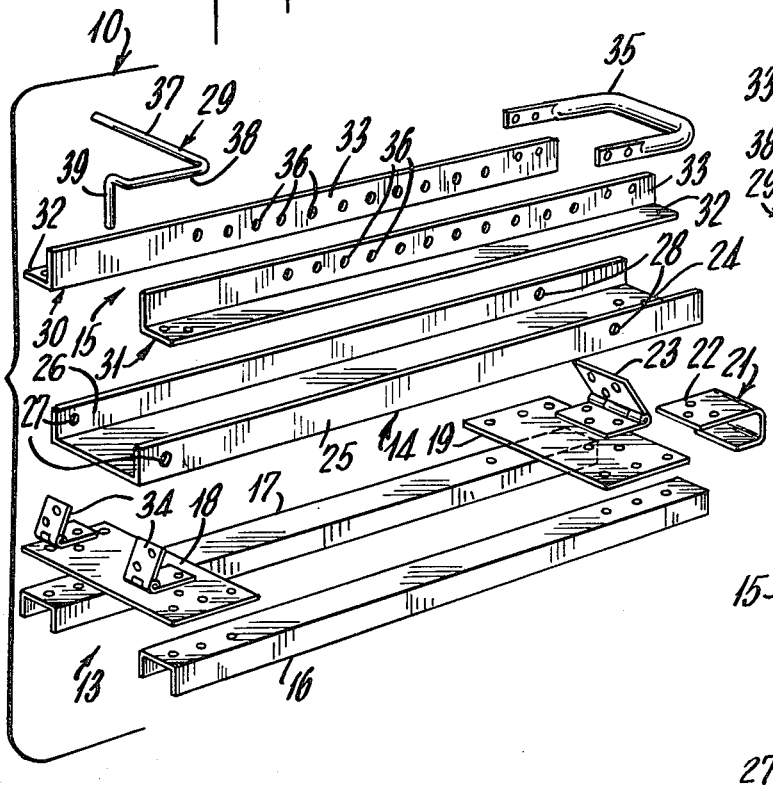
Figures 3, 4, 5, 6, 7:
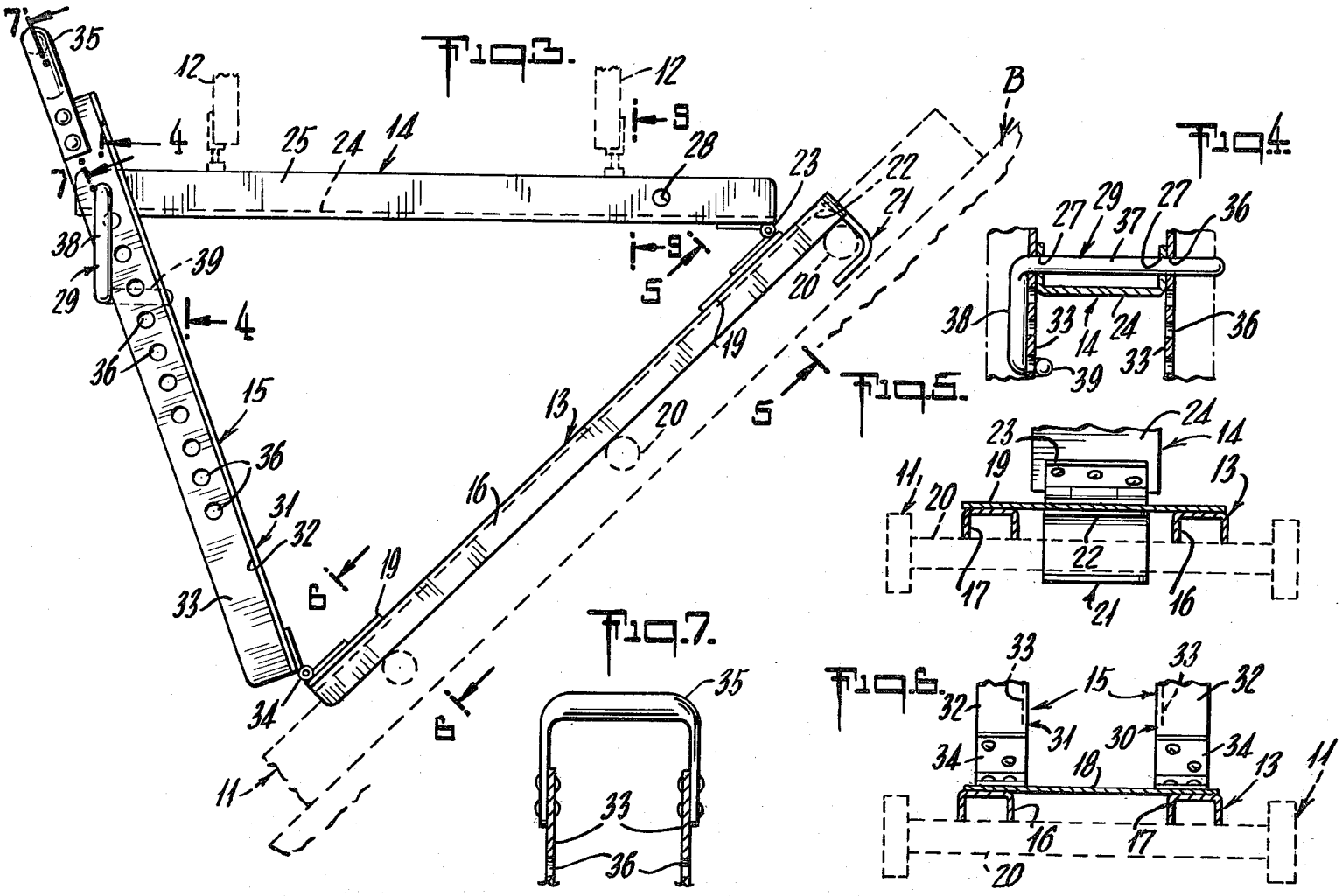
FIG. 3 is a side elevational view of the support in accordance with the invention positioned on an inclined ladder.

FIGS. 4, 5, 6 and 7 are cross sectional views of FIG. 3 taken along the lines 4—4, 5—5, 6—6 and 7—7 thereof;

FIG. 8 is an exploded view of the ladder support in accordance with the invention;

FIG. 9 is a cross sectional view of FIGS. 1 and 3 taken along the lines 9—9 thereof;

FIG. 10 is a fragmentary cross sectional view of a modified embodiment of the invention utilizing four hooks for engaging rungs of a ladder;

FIG. 11 is a cross sectional view of FIG. 10 taken along the lines 11—11 thereof; and FIG. 12 is a perspective view of the underside of the ladder support base shown in FIG. 10 and illustrating the arrangement of the rung engaging hooks.

The ladder support in accordance with the invention is denoted in FIG. 1 by the numeral 10 and is attached to an inclined ladder 11 for supporting a second ladder 12 in order to reach areas of the building B which would otherwise be accessible only by suitable scaffolding. It will be observed that the ladder support 10 can be positioned at any desirable location on an inclined ladder as denoted by the dotted line positions 10*a* and 10*b*. As will be shown, the ladder support 10 can be quickly and easily placed in position on a ladder and provides a secure rigid support for the ladder 12 with the stress being distributed among a plurality of the rungs of the ladder 11.

Referring now to FIGS. 2 through 9, the support in accordance with the invention comprises three basic elements namely, the base, the platform and the supporting struts which are denoted respectively by the numerals 13, 14 and 15. The base 13 comprises a pair of spaced parallel channels 16 and 17 of a suitable material such as magnesium, aluminum, steel or the like. The channels 16 and 17 are held in spaced parallel relationship by a pair of end plates 18 and 19 which may be secured to the channels by rivots, bolts, welding or other suitable means. In the illustrated embodiment of the invention, the channels 16 and 17 and the plates 18 and 19 have aligned openings for accommodating rivots or bolts as may be desired. Referring to FIG. 3, it will be observed that the length of the channels 16 and 17 is selected so that the support when positioned on the ladder will cause the channels 16 and 17 to span at least three rungs 20 of the ladder 11. The base 13 is affixed to the ladder 11, in the instant embodiment of the invention, by means of a hook 21 having an elongated leg portion 22 which underlies the plate 19 and is secured to the plate by bolts or rivots engaging corresponding holes in the plate and in the elongated leg 22 of the hook. As will be shown, a hinge 23 is secured to the topside of the plate 19 while the leg 22 of the hook underlies the plate 19. In order to distribute the pressure on the rung 20 engaged by the hook 21, the hook is preferably made relatively wide as shown more clearly in FIG. 5.

The platform 14 is a relatively wide channel of magnesium, aluminum, steel or the like and has a length substantially greater than the width of the ladder 12 to be supported thereby. The bottom portion 24 of the channel 14 and the upper leaf of the hinge 23 are provided with cooperating openings for receiving rivots or bolts to secure one end of the bottom to the hinge 23. The legs 25 and 26 of the platform 14 are provided with sets of aligned holes 27 and 28 to receive a locking pin 29 as will be described.

The platform 14 is held in a horizontal position when the ladder support is affixed to a ladder as illustrated in FIGS. 1 and 3 by means of a strut assembly 15 consisting of struts 30 and 31 each having angularly disposed leg portions 32 and 33. The bottom or left hand portion of each strut as shown in FIG. 8 is affixed to a hinge 34 by rivoting or other suitable means and the hinges 34 are in turn affixed to the plate 18 so that the angular positions of the struts 30 and 31 can be adjusted. The outer ends of the struts 30 and 31 are coupled by a U-shaped handle 35 by means of bolts or rivots engaging cooperating holes in the outer ends of the struts and the inwardly extending legs of the handle as shown more clearly in FIGS. 3 and 8. The struts 30 and 31 are also provided with sets of aligned holes 36 to accommodate the locking pin 29 as will now be described.

Figure 2:
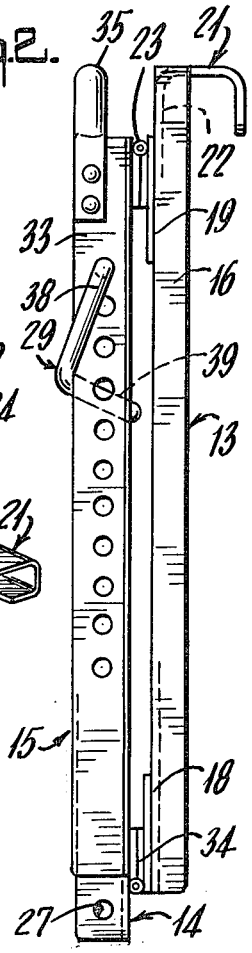
FIG. 2 is a side elevational view of the support in accordance with the invention in a collapsed position for carrying.

The ladder support is normally carried in a closed position as shown in FIG. 2 with the base 13, platform 14 and struts 15 placed in substantially parallel relationship with the elongated leg 37 of the locking pin 29 engaging the openings 28 in the platform 14 and the right hand set of openings 36 in the struts 30 and 31 as viewed in FIG. 8. The locking pin 29 is held in position by offset leg portions 38 and 39 with the portion 39 lying on the inside of the strut 31 to prevent accidental disengagement of the locking pin 29. To assemble the support, the locking pin 29 is disengaged from its position as illustrated in FIG. 2 after the base 13 has been placed on the ladder as illustrated in FIG. 3 with the hook 21 engaging one of the rungs. The platform 14 is then raised to a horizontal position and the struts 30 and 31 are adjusted so that one set of holes 36 are aligned with the holes 27 in the platform. The locking pin 29 is then placed in engagement with the aligned holes of the struts 30 and 31 and platform 14 and then rotated to a position with the offset leg portion 39 engaging the inside of the strut 31. In this way, the pin cannot become accidentally disengaged and the support is ready to receive the second ladder 12. FIG. 4 illustrates the locked position of the locking pin when the ladder support is in use. By reason of the plurality of sets of holes 36, the platform 14 can be adjusted to a horizontal position notwithstanding the inclination of the ladder 11. It is also to be understood that the lengths of the struts 30 and 31 as well as the length of the base 13 and platform 14 can be selected to meet any specific requirements. For instance, should the ladder 11 normally be used at a relatively steep inclination, the struts 30 and 31 can be made substantially longer. Similarly, the length of the platform would be selected to accommodate any size of ladder and the length of the base 13 can be arranged to bridge any number of rungs 20.

A modified embodiment of the invention is illustrated in FIGS. 10 through 12 and differs from the preceeding embodiment of the invention in that four hooking means are provided for the engagement of at least two ladder rungs in order to distribute the weight of the ladder 12 as illustrated in FIG. 1 more uniformly on the rungs 20 of the ladder 11.

In the form of the invention illustrated in FIGS. 10 through 12, like numerals have been utilized to denote corresponding elements of the form of the invention illustrated in the preceeding figures and it will be observed that with the exception of the hooking means both forms of the invention are substantially identical. In the modified embodiment of the invention, the hook 21 as illustrated in the preceeding embodiment has been replaced by four hooks 40 through 43. Each hook 40 through 43 is of U-shaped configuration and has a relatively long leg 44 which lies against the underside of its associated channel 16 or 17 as the case may be. A base or bridging portion 45 extends outwardly and a shorter leg extends from the base 45 in the same direction as the leg 44.

The leg 44 of each of the hooks 40 through 43 is secured to its associated channel 16 or 17 by rivots 47 and the lengths of the bridging sections 45 are sufficient to permit the legs 44 of each of the hooks to engage the underside of at least two ladder rungs 20 as shown more clearly in FIG. 10. In this way, the weight of the supported ladder 12 is distributed between two ladder rungs 20 and therefore both ends of the base 13 are securely held in position on the ladder 11. As previously mentioned, in all other aspects, the form of the invention illustrated in FIGS. 10 through 12 is substantially identical to that illustrated and described in connection with the preceeding embodiment of the invention.

While only certain embodiments of the invention have been illustrated and described, it is apparent that alterations, changes and modifications may be made without departing from the true scope and spirit thereof.

What is claimed is:

1. A ladder support for attachment to an inclined ladder to support a second ladder extending upwardly therefrom comprising an elongated base member adapted to lie against and span a plurality of rungs of said inclined ladder, said base member including a pair of spaced channels and plates secured to the ends of said channels to hold them in spaced relaship, hook means carried by the upper end of said base when in position on said inclined ladder for securing it to at least one of the rungs of the last said ladder, an elongated channel-shaped platform having upwardly extending leg portions hinged at one end to the upper end plate of said base when positioned on said inclined ladder, a strut assembly including a pair of independent elongated spaced members each hinged at one end to the lower end plate of said base, said members each having a plurality of holes disposed along the length thereof with the holes of one member being aligned with the holes of the other member, said platform channel having aligned openings in said legs and adjoining said other end thereof, a U-shaped handle secured to and extending from the free ends of said members to maintain them in parallel relationship, said handle extending beyond the adjoining plate on the base member when the base member, channel-shaped platform and struts are in the folded position for carrying the support to facilitate access to said handle for carrying said support, a locking pin engaging said platform openings and a selected set of openings in said members to maintain said platform in a substantially horizontal position when affixed to said inclined ladder, said platform including a second set of openings aligned with a set of openings on said strut assembly when the support is in the folded position to receive said locking pin to hold the support in the folded position and thereby providing a highly portable support readily transported by said handle.

2. A ladder support according to claim 1 wherein said locking pin is of L-shaped configuration and includes an elongated portion for engaging said strut and platform openings and a short portion terminating in an offset leg at 90° to both of the aforesaid portions and engaging an inner surface of one of said angle members to hold said locking pin in engagement with said platform and angle members.

3. A ladder support according to claim 2 wherein a relatively wide hook having an elongated shank secured to the underside of said upper plate, the outermost end of said hook being spaced from the adjoining ends of said channels for engaging a ladder rung with the channels engaging the outer surface of the last said rung.

4. A ladder support according to claim 1 wherein said hook means comprises four hooks secured to the ends of said channel members and extending outwardly from the undersides thereof, said hooks on each end of said base engaging a pair of spaced ladder rungs with said channels engaging the outer surfaces of the last said rungs.

* * * * *